US006311365B1

(12) United States Patent
Dornier

(10) Patent No.: US 6,311,365 B1
(45) Date of Patent: Nov. 6, 2001

(54) STEAM CLEANING DEVICE

(75) Inventor: Irén Dornier, Madrid (ES)

(73) Assignee: Dornier Technologies GmbH & Co., Munich (DE)

( * ) Notice: Subject to any disclaimer, the term of this patent is extended or adjusted under 35 U.S.C. 154(b) by 0 days.

(21) Appl. No.: 09/091,148

(22) PCT Filed: Nov. 29, 1996

(86) PCT No.: PCT/DE96/02293

§ 371 Date: Apr. 1, 1999

§ 102(e) Date: Apr. 1, 1999

(87) PCT Pub. No.: WO97/20490

PCT Pub. Date: Jun. 12, 1997

(30) Foreign Application Priority Data

Dec. 6, 1995 (DE) ..... 195 45 517

(51) Int. Cl.[7] ..... B08B 3/00

(52) U.S. Cl. ..... 15/302; 15/320; 15/345

(58) Field of Search ..... 15/320, 345, 302, 15/321

(56) References Cited

U.S. PATENT DOCUMENTS

| | | | | |
|---|---|---|---|---|
| 2,497,435 | * | 2/1950 | Branneman | 15/321 X |
| 3,439,374 | * | 4/1969 | Wisdom | 15/321 |
| 3,755,850 | * | 9/1973 | Porter | 15/320 |
| 4,369,544 | * | 1/1983 | Parisi | 15/320 |
| 4,696,074 | * | 9/1987 | Cavalli | 15/321 |
| 5,386,612 | * | 2/1995 | Sham | 15/320 |
| 5,400,462 | * | 3/1995 | Amoretti | 15/321 |
| 5,613,271 | * | 3/1997 | Thomas | 15/321 |

* cited by examiner

*Primary Examiner*—Chris K. Moore
(74) *Attorney, Agent, or Firm*—Tuettner Pyle & Piontek

(57) ABSTRACT

The steam cleaning device contains a steam cleaning head with several steam pressure chambers connected to a steam generator, as well as suction regions connected to a vacuum source. The suction regions are constantly supplied with fresh air from a fresh air chamber connected to the outer surroundings of the cleaning head, in order to improve transport of the steam/water/dirt/air mixture to a backward vacuum lock in the steam cleaning head. Suction slits around the periphery of the steam cleaning head ensure completely stripe-free cleaning of, for example, window surfaces. The steam cleaning head can be part of an automatic cleaning machine used for cleaning windows and skyscraper facades.

22 Claims, 3 Drawing Sheets

STEAM CLEANING DEVICE

The present invention relates to a steam cleaning apparatus, in particular for an automatic cleaning apparatus for window and facade surfaces. The invention, however, is not restricted to such an application; rather, the steam cleaning apparatus of the invention can also be operated by hand, and its applications are not limited to the cleaning of window and facade surfaces, but it can serve many cleaning purposes on preferably even, but for example also curved surfaces.

EP 0 243 323 A discloses a steam cleaning head which is guided as a hand-held device over window panes, floors or washable walls and has a housing similar to that of a conventional vacuum cleaner. In one embodiment the housing has disposed therein a distribution tube which extends over the entire width and is provided with small holes from which steam exits. Said distributor has secured thereto a sponge which also extends over the entire width of the housing and which is guided over the surface to be cleaned. In another embodiment, steam exits from a chamber which extends over the entire width of the housing and which towards the outside of the housing is confined by a brush while in parallel with the one steam cleaning chamber a suction chamber follows that also extends over the entire length of the housing and is enclosed by elastic brooms. The steam passes between the elastic bristles of the brooms into the suction chamber. This embodiment is intended for cleaning floor surfaces.

It is the object of the present invention to provide a steam cleaning apparatus for cleaning soiled surfaces, such as window or facade surfaces, in a highly efficient manner. In particular, the steam cleaning apparatus should be suited as part of an automatic cleaning machine for window and facade surfaces.

This object is achieved according to the invention by the features of patent claim 1.

Advantageous developments of the invention are characterized in the subclaims.

The steam cleaning apparatus of the invention contains a steam cleaning head which includes a plurality of separate steam pressure chambers which communicate with a steam generator, and a plurality of separate suction regions provided at the front side, which are connected to a vacuum source. For cleaning, for example, a window surface, the steam cleaning head of the invention is placed on said surface, whereupon steam is supplied from the steam pressure chambers at the front side at a steam pressure of up to about 4 bar. An overpressure which lifts the steam cleaning head from the window surface by a small distance is thereby created in the steam pressure chambers. The steam flows beyond the front confinement of the steam pressure chambers into the front suction regions where, for example, a vacuum prevails in the order of about 0.2 bar. As a result, a gap of a predetermined width is obtained between the steam cleaning head and the surface to be cleaned, so that the steam cleaning head can be guided without any contact with the window pane over the surface to be cleaned. This guarantees that a window pane or another surface to be cleaned cannot be damaged, for instance scratched, by the steam cleaning head.

The steam cleaning head is expediently supported on a steam layer which constantly flows out of the steam pressure chambers into the suction regions. A highly efficient cleaning effect is thereby obtained, because the hot steam removes the dirt particles from the window surface and carries them along while flowing off into the suction regions.

Part of the steam condenses, so that a mixture of steam, water, air and dirt is sucked off from the window pane.

The steam pressure chambers should be distributed over the front working surface of the steam cleaning head in such a manner that when the window surface is preferably treated in rows the surface is swept over in all regions by at least one steam pressure chamber, but preferably by a plurality of steam pressure chambers. According to a further suggestion of the invention, additional suction slits may be provided in the edge region of the steam cleaning head, whereby it is ensured that the surface to be cleaned becomes clean without any stripes. When the steam cleaning head in its region that is the rear one when viewed in the working direction is additionally provided with a wiper that consists, for example, of silicone, the cleaned surface will dry rapidly without any stripes.

It is within the scope of the invention that chemicals can be added to the water to be evaporated in order to increase steam efficiency in the case of impurities that are difficult to remove.

In a preferred embodiment of the invention the steam pressure chambers have an elongated shape and are arranged in surrounding fashion at least in the edge portion of the steam cleaning head. When the steam cleaning head has a circular round shape when viewed from the front, steam pressure chambers are consequently arranged side by side in the form of a circular ring. Moreover, there may be provided preferably spaced-apart radial steam pressure chambers which have positioned thereinbetween the suction regions provided at the front side.

When, as is particularly preferred, the steam cleaning head has a delta shape with slightly rounded sides, steam pressure chambers are again arranged side by side along the edge portion and are followed radially on the inside by a suction region. This suction region is defined by a circular annular arrangement of further steam pressure chambers in the interior of which a suction region is again found.

With such an arrangement of the steam pressure chambers, the surface to be cleaned is swept over successively by a plurality of steam pressure chambers so that it is cleaned everywhere.

The steam pressure chambers are expediently equipped with a bottom wall and surrounding short webs adjacent thereto, so that they have a flat U-shape when viewed in crosss section.

Each of the individual steam pressure chambers communicates via a plurality of nozzles with a rear steam distribution chamber which has a pressure tube opening thereinto for supplying steam. Apart from the opening of the pressure tube and the nozzles by which steam is introduced into the steam pressure chambers, the steam distribution chamber is closed on all sides.

The front suction regions, in turn, communicate via suction sleeves with a joint suction chamber in the rear part of the steam cleaning head which has a suction tube connected thereto. Hence, the joint suction chamber forms a suction bell into which the mixture of steam, condensed water, dirt and air is sucked before it is discharged through the suction tube.

In a particularly advantageous development, a fresh-air distribution chamber is formed in the steam cleaning head and, when viewed in axial direction of the steam cleaning head, is expediently located between the front arrangement consisting of steam pressure chambers and suction regions and the steam distribution chamber. The fresh-air distribution chamber communicates via holes, preferably in the radial circumferential wall of the steam cleaning head, with the surroundings thereof and, via ducts extending through the partition between the fresh-air distribution and the suction regions, with said suction regions. Hence, during operation of the steam cleaning head, air is constantly sucked into the suction regions, which promotes transport of the steam/water/dirt mixture. The cleaning effect of the steam cleaning head of the invention is thereby enhanced considerably.

Moreover, in a particularly advantageous development, suction slits are formed along the front circumference of the steam cleaning head and are preferably located directly radially inside the housing wall where small webs and large suction regions may be arranged in alternating fashion. These suction slits communicate with the suction bell and efficently prevent the steam/water/dirt mixture from laterally exiting from the steam cleaning head.

According to a further embodiment of the invention, the steam cleaning head is mounted on a slide which is movable on rails that are positioned on a frame which is, for example, suspended via ropes from a crane which is movable on rails on the roof of a building. The remaining units, such as the steam generator, can be arranged on the frame or a lift cage, which need not be described here in more detail. During operation of the steam cleaning apparatus the rails are expediently arranged horizontally in front of the window surface, and the frame is vertically movable, and it must, of course, be protected from pendulum motions in a suitable manner. The steam cleaning head treats the window surface horizontally in rows, whereupon the frame is moved vertically each time, so that the whole window surface is treated successively.

It is within the scope of the present invention that the steam cleaning head can also be moved over the window surface (or other surface) to be cleaned by means of a robot which is arranged on a frame.

As already stated above, the steam pressure may be about 4 bar, while the suction pressure is about 0.2 bar, without the invention being limited to said values. Under a further aspect of the invention the ratio of the surfaces of the steam pressure chambers to the total surface of the suction regions can be chosen such that there remains a slight suction surplus, with the effect that the steam cleaning head is always held with a slight suction on the surface to be cleaned.

Further details of the invention will become apparent from the following description of preferred embodiments of the invention.

Figure 1:
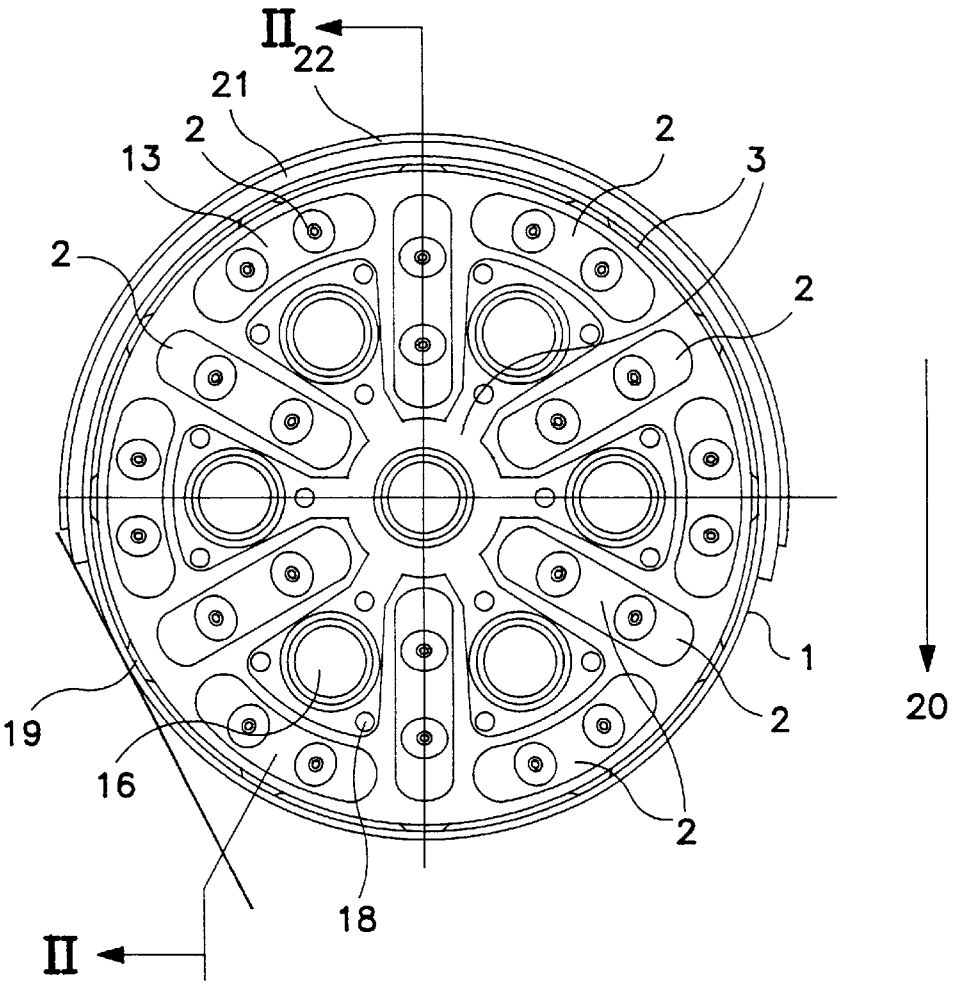
FIG. 1 is a front view of a first embodiment of the steam cleaning head.
Figure 2:
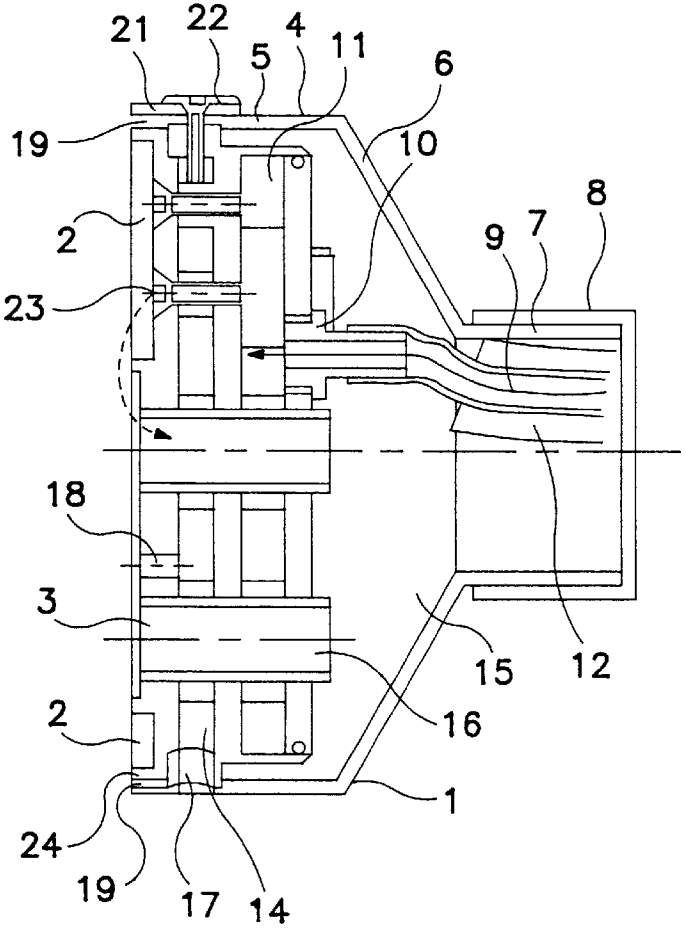
FIG. 2 is a longitudinal section through the cleaning head according to FIG. 1 along a line II—II.

As shown in FIGS. 1 and 2, the steam cleaning head 1 comprises a plurality of steam pressure chambers 2 which are arranged side by side at the edge of the steam cleaning head to form a circle, th radially extending steam pressure chambers engaging into the remaining spacings. Suction regions 3 are positioned between the steam pressure chambers 2 and radially outside of said chambers.

As shown in FIG. 2, a housing 4 of the steam cleaning head 1 has a circular cylindrical section 5 which is followed by a conical section 6 which is centrally equipped with a cylindrical projection 7 that has seated thereon a suction tube 8 which communicates with a vacuum source (not shown). Inside the suction tube 8, a pressure tube 9 leads into the interior of the steam cleaning head 1 which communicates via a connection member 10 with the interior of a steam distribution chamber 11. The pressure tube 9, which is surrounded by an insulation 12, communicates with a steam generator (also not shown).

The steam distribution chamber 11 communicates via steam nozzles 13 with the steam pressure chambers 2 through rear walls thereof. The steam nozzles 13 extend through a fresh-air chamber 14 which is arranged between the steam pressure chambers 2 and the steam distribution chamber 11 and will be described in more detail further below.

In the rear portion of the steam cleaning head 1, there is provided a suction bell 15 which is in communication with the suction tube 8 and which is connected via sleeves 16 to the suction regions 3 at the front side.

Circumferentially spaced-apart holes 17 through which air is sucked into the fresh-air chamber 14 which, in turn, is connected via holes 18 to the suction regions 3 lead through the circumferential wall 5 of the steam cleaning head 1. Moreover, circumferentially spaced-apart suction slits 19 which communicate with the suction bell 15 are formed directly radially inside the circumferential wall 5.

The standard working direction of the steam cleaning head 1 is outlined by arrow 20 in FIG. 1. In the portion of the steam cleaning head which is the rear one with respect to the working direction, a silicone wiper 21 is secured by means of a holding plate 22, the silicone wiper resting on the surface to be cleaned and wiping off liquid remaining on said surface to ensure that the cleaned surface will dry more rapidly.

The steam cleaning head 1 operates as follows: steam is first introduced through the pressure tube 9 into the steam distribution chambers 11 and from said chambers through the nozzles 13 into the steam pressure chambers 2 where an overpressure is created which lifts the front plane 23 of the steam cleaning head from the surface to be cleaned by a gap of a definable size. As shown in FIG. 2 by a broken line, steam flows through said gap into the suction regions 3, with a water/steam/air mixture entraining the dirt particles detached from the surface to be cleaned.

At the same time, fresh air flows through the holes 17 into the fresh-air chamber 14 and from said chamber through holes 18 into the suction regions 3, whereby transport of the mixture is considerably improved.

Steam/water/air/dirt mixture also exits via the edge webs 24 of the steam pressure chambers 2 radially to the outside and is there subjected to a fresh-air suction which leads through circumferential slits 19 into the suction bell 15. The mixture which is inside the suction regions 3 is also sucked into the bell through the sleeves 16 before it is transported away through the suction tube 8.

During the row-like treatment of a window pane the silicone wiper 21 wipes off the remaining liquid on the rear edge, with the liquid being also sucked off through the edge slits 19.

Figure 3:
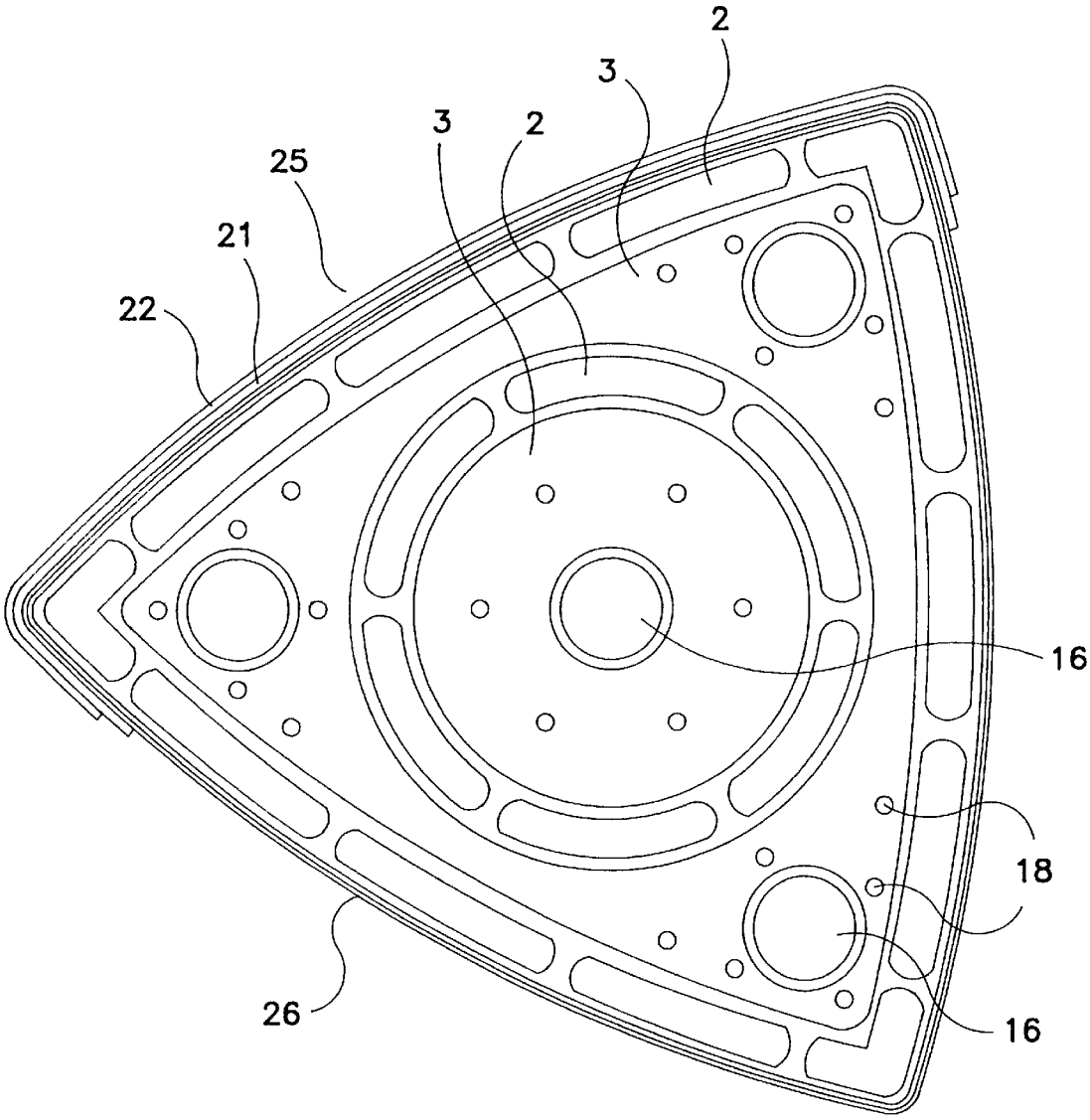
FIG. 3 is a front view of a further embodiment of the steam cleaning head.

FIG. 3 shows a particularly preferred embodiment of a steam cleaning head 25 which has a delta shape with slightly rounded side surfaces 26. Such a shape is of particular advantage because corner portions of a window can thus be cleaned in an efficient manner.

In the steam cleaning head 25, a plurality of steam pressure chambers 2 are also provided in the slightly rounded delta shape such that they extend in surrounding fashion on the edge, and steam pressure chambers 2 are arranged in circular fashion radially in the interior. Suction regions 3 into which the sleeves 16 and the holes 18 are guided are provided between said chambers.

Figure 4:
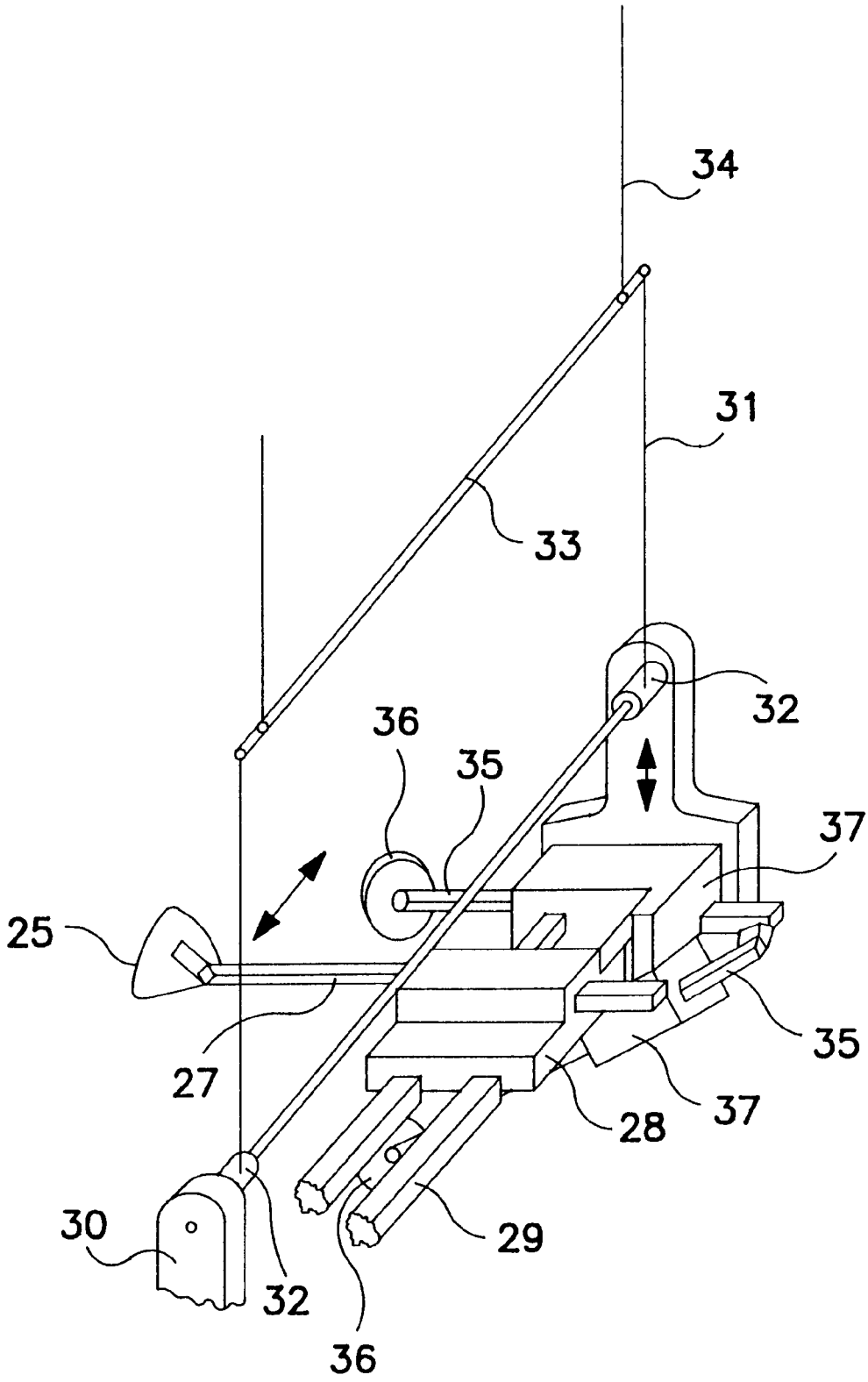
FIG. 4 is a substantially schematic illustration of a frame with a slide guide for the steam cleaning head.

FIG. 4 is a purely schematic illustration which shows that the steam cleaning head 1 or 25 is articulated to a rigid holding arm 27 which is anchored in a slide 28 such that the holding arm 27 is extended at the desired length. The slide 28 is seated on two rails 29 which are secured to a frame 30 that is suspended from ropes 31, the ropes 31 being adapted to be wound onto or unwound from rope drums 32 to move the frame 30 in vertical direction.

The ropes 31 are suspended from a transverse bar 33 which is hung via ropes 34 to a crane (not shown) on the roof of a skyscraper.

When a window surface is cleaned, the frame 32 is first arranged at such a height in front of the window surface that the cleaning head 25 can move along the uppermost path of the window. In this position, the frame 32 is fixed by means of slide legs 35, whose head ends are equipped with suction cups 36, to the facade surface at a selected distance at which the steam cleaning head 25 almost rests on the window surface. When the window surface is treated by the steam cleaning head 25 in rows in that the slide 28 is moved accordingly on the rails 29, the frame 30 is stepwise lowered by the width of a cleaning row in that a corresponding rope length is unwound from the winches 32, with the suction cups 36 remaining stuck to the facade and the rotationally supported slide legs 35 moving in their bearings 37 such that the distance of the frame 30 from the window surface remains constant. Such a configuration reliably prevents the frame 30 from performing any pendulum motions caused by wind forces or the drive force of the slide.

What is claimed is:

1. A steam cleaning apparatus for cleaning a flat surface, said apparatus comprising:

a) a steam cleaning head, a front side on said steam cleaning head for engaging said surface, a plurality of steam pressure chambers in said head, a steam generator means for supplying steam to said plurality of steam pressure chambers, a web surrounding each of said plurality of steam pressure chambers, said webs terminating in a joint plane at said front side;

b) a plurality of separate suction stations, a vacuum source connected to said plurality of suction stations, c) said steam pressure chambers in operation causing said head to be displaced from the flat surface by a gap, with steam from said steam pressure chambers being vacuumed by the suction stations across said webs.

2. The steam cleaning apparatus according to claim 1, wherein each of said steam pressure chambers having a rear wall, a steam nozzle extending through said rear wall, each of said webs extends from said rear wall.

3. The steam cleaning apparatus according to claim 2, further comprising a steam distribution chamber, said distribution chamber located axially behind said steam pressure chambers, said distribution chamber communicating through said nozzles with said steam pressure chambers.

4. The steam cleaning apparatus according to claim 3, further comprising a pressure tube, said pressure tube connecting said steam generator to said steam distribution chamber.

5. The steam cleaning apparatus according to claim 1, wherein said steam cleaning head has a rear portion, and further comprising a plurality of suction sleeves; a joint suction chamber in said rear portion; said suction sleeves connecting said suction regions at said front side with said joint suction chamber; and a suction tube connecting said joint suction chamber with said vacuum source.

6. The steam cleaning apparatus according to claim 5, further comprising a pressure tube through which steam travels, said pressure tube inside said suction tube, said pressure tube extending through said joint suction chamber.

7. The steam cleaning apparatus according to claim 1, wherein said steam cleaning head has a front section and a subsequent rear section, and wherein when viewed in longitudinal section said steam cleaning head front section is substantially cylindrical and said rear section is substantially conical shaped.

8. The steam cleaning apparatus according to claim 1, wherein said steam cleaning head has a housing, and wherein when viewed in longitudinal section said steam cleaning head housing is substantially cylindrical shaped.

9. The steam cleaning apparatus according to claim 1, wherein said steam cleaning head is substantially delta-shaped when viewed from the front.

10. The steam cleaning apparatus according to claim 1, wherein said steam cleaning head has a circular shape when viewed from the front.

11. The steam cleaning apparatus according to claim 1, further comprising a fresh-air distribution chamber, said fresh air distribution chamber communicating with the surroundings of said steam cleaning head, a plurality of holes connecting said fresh air distribution chamber with said suction regions at said front side.

12. The steam cleaning apparatus according to claim 11, wherein said fresh-air distribution chamber is arranged axially behind said suction regions at said front side.

13. The steam cleaning apparatus according to claim 1, wherein said steam cleaning head has a front circumference; and further comprising a plurality of suction slits, said suction slits distributed over said steam cleaning head front circumference.

14. The steam cleaning apparatus according to claim 1, further comprising a wiper, said wiper secured to said steam cleaning head, said wiper during operation of said steam cleaning head resting on the flat surface.

15. The steam cleaning apparatus according to claim 1, wherein said steam pressure chambers generating steam pressure of about 4 bar.

16. The steam cleaning apparatus according to claim 1, wherein in operation said suction stations generating suction pressure of about 0.2 bar.

17. The steam cleaning apparatus according to claim 1, wherein a ratio of the surface area of said steam pressure chambers to the surface area of said suction regions is such that there remains a slight suction surplus.

18. The steam cleaning apparatus according to claim 1, further comprising a slide, rails, and a frame; wherein said steam cleaning head held on said slide, said slide movable along said rails, and said rails mounted on said frame.

19. The steam cleaning apparatus according to claim 18, wherein said rails are arranged in a substantially horizontal direction and wherein said frame is vertically movable.

20. The steam cleaning apparatus according to claim 1, further comprising a robot, said robot moving said steam cleaning head over the flat surface.

21. A steam cleaning apparatus for automatic cleaning of window and facade surfaces, comprising a steam cleaning head, having a front side with a circumference, said head comprising:

a) a plurality of steam pressure chambers, each of said steam pressure chambers having a rear wall; a steam nozzle extending through said rear wall, a short web extends from said rear wall and surrounding said steam pressure chambers, said webs terminating in a joint plane at the front side, said steam chambers for discharging steam at the head front side;

b) a steam distribution chamber arranged axially behind said steam pressure chambers, said distribution chamber operatively connected with said steam nozzles;

c) a steam generator, a pressure tube operatively connecting said steam generator with said steam distribution chamber;

d) a plurality of separate suction regions at the front side, a plurality of suction sleeves connecting said suction regions with a joint suction chamber in a rear portion of said steam cleaning head, a vacuum source operatively connected by a suction tube with said joint suction chamber, said suction regions for intaking steam along the head front side;

e) a fresh air distribution chamber arranged axially behind said suction regions at the front side; said fresh air distribution chamber communicating with the surroundings of said steam cleaning head, a plurality of holes connecting said fresh air distribution chamber with said suction regions; said fresh-air distribution chamber;

f) a plurality of suction slits distributed over the front circumference of said steam cleaning head, said slits communicating with said suction chamber;

g) a wiper secured to said steam cleaning head, said wiper resting on the surface to be cleaned during operation of said steam cleaning head;

h) said steam chambers generating steam pressure during operation of said cleaning head of about 4 bar, and said suction regions generating suction pressure of about 0.2 bar; and wherein during operation of the said cleaning head steam flows across said webs of said steam pressure chambers into said suction regions so that a gap is formed between said steam cleaning head and the surface to be cleaned.

22. A steam cleaning apparatus according to claim 21, further comprising a slide movable along substantially horizontal rails, said rails mounted on a vertically movable frame, said steam cleaning head held on said slide; and wherein said steam cleaning head is moved by means of a robot over the surface to be cleaned.

* * * * *